US006432623B1

(12) United States Patent
Donovan et al.

(10) Patent No.: US 6,432,623 B1
(45) Date of Patent: Aug. 13, 2002

(54) METHOD FOR PROCESSING A PHOTOGRAPHIC ELEMENT COMPRISING A SIMULTANEOUSLY COATED PROTECTIVE OVERCOAT

(75) Inventors: Kevin M. Donovan, Bergen; Lloyd A. Lobo, Webster, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/844,050

(22) Filed: Apr. 27, 2001

(51) Int. Cl.[7] ..... G03C 5/26; G03C 7/30
(52) U.S. Cl. ..... 430/403; 430/531; 430/935
(58) Field of Search ..... 430/403, 531, 430/935

(56) References Cited

U.S. PATENT DOCUMENTS 5,308,593 A * 5/1994 Kobayashi et al. ..... 430/935
5,427,896 A * 6/1995 Hayashi et al. ..... 430/372
5,607,820 A * 3/1997 Nakamura ..... 430/393
5,656,417 A * 8/1997 Endoh et al. ..... 430/935
5,856,051 A 1/1999 Yau et al. ..... 430/14
6,194,130 B1 2/2001 Nair et al. ..... 430/350

OTHER PUBLICATIONS

Jones et al., "Protective Overcoat for Photographic Elements", USSN 09/621,267, (Attorney Docket No. 80609), filed Jul. 21, 2000

* cited by examiner

*Primary Examiner*—Hoa Van Le
(74) *Attorney, Agent, or Firm*—Chris P. Konkol

(57) ABSTRACT

A method of processing a photographic imaging element to obtain a protective overcoat is disclosed, which overcoat provides, in the final product, resistance to fingerprints, common stains, and spills. More particularly, the present invention involves a processing-solution-permeable overcoat that becomes water and stain resistant in the photochemically processed product. The overcoat formulation comprises at least one water-dispersible hydrophobic polymer interspersed with a water-soluble polymer. During development or thereafter, before drying, the water-soluble polymer is removed to a significant extent. Subsequently, the imaged element is dried at an elevated temperature to facilitate coalescence of the overcoat to thereby provide enhanced stain resistance and water-resistance.

20 Claims, No Drawings

METHOD FOR PROCESSING A PHOTOGRAPHIC ELEMENT COMPRISING A SIMULTANEOUSLY COATED PROTECTIVE OVERCOAT

FIELD OF THE INVENTION

The present invention relates to a method of processing a photographic imaging element to obtain a protective overcoat that provides resistance to fingerprints, common stains, and spills. The overcoat formulation comprises at least one water-dispersible hydrophobic polymer interspersed with a water-soluble polymer. The imaged photographic element is dried at an elevated temperature to facilitate coalescence of the hydrophobic polymer in the overcoat, thereby providing enhanced stain resistance and water resistance.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements, a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin or similar natural or synthetic hydrophilic polymers have proven to be the binders of choice for silver halide photographic elements. Unfortunately, when gelatin or similar polymers are formulated so as to facilitate contact between the silver halide crystals and aqueous processing solutions, the resultant coatings are not as fingerprint and stain resistant as would be desirable, particularly in view of the handling or environment that an imaged photographic element may commonly experience at various times and circumstances. Thus, fingerprints can permanently mark the imaged element. The imaged element can be easily stained by common household products, such as foods or beverages, for example, coffee spills.

There have been attempts over the years to provide protective layers for gelatin based photographic systems that will protect the images from damages by water or aqueous solutions. U.S. Pat. No. 2,173,480 describes a method of applying a colloidal suspension to moist film as the last step of photographic processing before drying. A series of patents describes methods of solvent coating a protective layer on the image after photographic processing is completed and are described in U.S. Pat. Nos. 2,259,009, 2,331,746, 2,798,004, 3,113,867, 3,190,197, 3,415,670 and 3,733,293. U.S. Pat. No. 5,376,434 describes a protective layer formed on a photographic print by coating and drying a latex on a gelatin-containing layer bearing an image. Various lamination techniques are known and practiced in the trade. U.S. Pat. Nos. 3,397,980, 3,697,277 and 4,999,266 describe methods of laminating a polymeric sheet film, as a protective layer, on a processed image.

Protective coatings that need to be applied to the image after it is formed, several of which were mentioned above, adds a significant cost to the final imaged product. Thus, the processing equipment needs to be modified and the personnel running the processing operation need to be trained to apply the protective coating. A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene have a melting temperature (Tm) of 55 to 200° C., and are therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. Again, however, fusing is required by the photofinishing laboratories to render the protective overcoat water-resistant. Similarly, commonly assigned U.S. Ser. No. 09/353,939 and U.S. Ser. No. 09/548,514, respectively, describe the use of a polystyrene-based material and a polyurethane-based material, with gelatin as the binder, in an overcoat for a photographic element, which overcoat can be fused into a water resistant overcoat after photographic processing is accomplished to generate an image.

Commonly assigned U.S. Ser. No. 09/235,436 discloses the use of a processing solution permeable overcoat that is composed of a urethane-vinyl copolymer having acid functionalities. Commonly assigned U.S. Ser. No. 09/235,437 and U.S. Pat. No. 6,194,130 B1 disclose the use of a second polymer such as a gelatin or polyvinyl alcohol to improve processibility and reduce coating defects. Commonly assigned U.S. Ser. No. 09/621,267 discloses the use of a processing solution permeable overcoat that is composed of various non-gelatin containing water-dispersible polymers in combination with a water-soluble polymer.

While the prior art has disclosed imaging elements with a processing permeable overcoat that is rendered water impermeable, and the materials used to prepare such overcoats, it has not been specific in how these imaging elements have been prepared. The desired overcoat may be applied in several possible methods. It may be applied to a imaging element that is previously coated with all layers except the overcoat. In such a case, the overcoat may be applied as a single layer. It also could be applied in a single coating operation, in a tandem method. In this case all the layers, except the desired overcoat can be applied at a first station in the coating machine. The web is then dried and run through a second coating station, without winding it up, where the overcoat is applied.

The most preferred method for coating an overcoat is at a single coating station, along with the other imaging layers. This is typically accomplished with gelatin overcoats using a slide hopper where multiple solutions are layered without mixing. The layered solutions are then deposited on the web either by bead coating or by dropping it as a curtain onto the web.

PROBLEM TO BE SOLVED BY THE INVENTION

A polymeric latex protective overcoat when coated simultaneously with underlying emulsion layers in a so-called single pass operation, during manufacture of a photographic imaging element, has been found not to deliver the same stain protection features observed when coated separately in a so-called "two-pass" coating operation. Thus, it has been found that the functionality of the overcoats employed in the present invention, with specific reference to its water permeability, can be different depending on whether the polymer layer is coated simultaneously with the imaging layers or in a separate process step. In the simultaneous coating method, the solution of the water-dispersible and water-soluble polymer is in fluid contact with a solution containing the imaging chemistry and its hydrophilic binder (usually, gelatin). It is found that the stain resistance and water permeability of the overcoat applied in this manner, is greatly diminished. Without being bound by theory, it is believed that some water soluble components from the adjacent imaging layers travel to the overcoat and, thus, making it difficult for the polymer latexes to form a continuous film and, thereby, preventing or decreasing coalescence of the latex in the final imaged product.

It would be desirable to obtain an imaging element comprising an overcoat that is process-permeable during photoprocessing and which can be converted to a water-resistant protective overcoat for the imaged element, which water resistance is not lost or decreased when the overcoat is simultaneously coated with the emulsion layers. It would be further desirable if this could be accomplished without the addition of laminating or fusing steps, without the need for high temperature fusing, and preferably with minimal or no additional equipment to carry out photoprocessing

SUMMARY OF THE INVENTION

The present invention provides a method of forming an image in an imaging element and converting the overcoat into a water-resistant coating. In particular, it has been found that stain resistance and/or water resistance of an imaged element having a protective overcoat can be obtained or enhanced, when the overcoat (nascently protective) is coated simultaneously with the gelatin-based emulsion layers, by subjecting the product, after it emerges from the last photoprocessing step, to an elevated temperature, above 160° F. for a given period of time This can involve a sustained period of time beyond minimal drying of the photographic element, such that the temperature of photographic element can reach or approach said elevated temperature. This drying of the image element at elevated temperatures facilitates coalescence of the latex in the overcoat, thus rendering the product more resistant to staining and/or water.

The imaged element processed according to the present invention comprises a processing-solution-permeable overcoat for a photographic element. For example, such a photographic element may comprise a support, at least one silver-halide emulsion layer superposed on the support, and overlying the silver-halide emulsion layer, a processing-solution-permeable protective overcoat composition that can be incorporated into or coated on the imaging element during manufacturing and that does not inhibit photographic processing. A component of the invention are polymer particles that are water-dispersible. The material of the invention can be introduced to the overcoat coating melt in a latex form or as a conventional colloidal dispersion in a water-soluble binder. The presence of a water-soluble component that is substantially washed out during processing allows photographic processing to proceed at an acceptable rate. The washing out of the water-soluble component facilitates the coalescence of the water-dispersible materials to form a water resistant continuous layer in the final product.

In one embodiment of the invention, the overcoat composition applied to the imaging element comprises 30 to 95 weight percent, based on the dry laydown of the overcoat, of water-dispersible polymer particles having an average of between 0.01 to 0.5 micrometers, said water-dispersible polymer being characterized by a $T_g$ (glass transition temperature) of between −40 and 80° C. In general, the overcoat composition preferably contains a water-soluble, hydrophilic polymer that is typically noncrosslinked to facilitate its washing out during processing and, at least to some extent, to facilitate the coalescence of the water-dispersible polymer particles. Preferably, the overcoat formulation is substantially gelatin-free, comprising less than 5% crosslinked gelatin by weight of solids.

In another embodiment of the invention, the overcoat composition applied to the imaging element comprises 5 to 70% by weight of solids of water-soluble hydrophilic polymer such that more than 30 weight percent of the water-soluble polymer is washed out during photographic processing; wherein the weight ratio of the water-dispersible polymer to the non-crosslinked water-soluble polymer is between 60:40 to 85:15 and whereby the overcoat forms a water-resistant overcoat after photoprocessing without fusing.

DESCRIPTION OF THE PREFERRED EMBODIMENTS

The present invention provides a simple and inexpensive way to improve the water, stain and abrasion resistance of processed photographic elements. In accordance with the invention, the protective overcoat is applied over the photographic element prior to exposure and processing. In particular, a overcoat formulation according to the present invention is applied to the emulsion side of photographic products, particularly photographic prints, which may encounter frequent handling and abuse by end users.

By the term "water-resistant" is meant herein after ordinary photoprocessing and drying does not imbibe water or prevents or minimizes water-based stains from discoloring the imaged side of the photographic element. By the term "non-crosslinked gelatin" is meant gelatin that is water soluble.

By the term "elevated temperature", as used in this application, to dry and/or facilitate coalescence of the water-dispersible polymer, is herein meant a temperature of greater than 160° F., preferably between 160 and 212° F., more preferably 170 to 200° F., most preferably 180 to 195° F. In contrast, fusing typically requires a pressure roller or belt and drying of the imaged element before fusing. In contrast, fusing, which involves simultaneously applied heat and pressure, for example by means of a nip between two rollers, generally requires higher temperatures, typically above the boiling point of water, usually above 100° C. For that reason, fusing normally is applied to an imaged element only after drying.

The heating step according to the present method cannot be applied prior to the typical processing sequence (involving, for example, the three steps of developing, bleach-fixing, and washing), whether the imaging element is heated dry or in the presence of a water film. In other words, when the water-soluble polymer is still in the coating (the water film does not allow the water-soluble polymer to exit the overcoat), the desired stain resistance enhancement cannot be achieved by high temperature heating. Similarly, if the imaging element is dried mildly after the processing, for example, after washing, and the high temperature treatment is then applied to a dried film, the enhanced stain resistance cannot be achieved. Thus, the high temperature treatment has to be applied to the imaging element, while it is wet, after it has gone through the three processing steps mentioned above. Preferably, the elevated temperature needs to be applied to the photographic element when it is at least 100% saturated with water.

The results show that a wide variety of water-dispersible polymers respond favorably to the high temperature drying after processing in accordance with the present method. It is preferred that the Tg of the polymers be below 100° C. in order to respond most favorably to the high temperature drying. In a preferred embodiment the polymeric overcoat, materials comprises polyester ionomers such as AQ-55® polyester manufactured by Eastman Chemical (Tg—55° C.), dispersed polyurethane lattices, NEOCRYL acrylic polymers manufactured by Zeneca, acrylic/urethane interpenetrating polymers, and the like, disclosed for example in commonly assigned patent applications U.S. Pat. No. 6,077,648, U.S. Ser. No. 09/235,437 U.S. Pat. No. 6,194,130 B1, U.S. Ser. No. 09/621,267, hereby incorporated by reference in their entirety.

In typical large scale photofinishing machines, the dryer settings can vary, depending on the length of the drier and the load (amount of material to be dried). If the length is short and/or the load is heavy, higher temperatures are typically used. However, because of the cost of drying energy, the driers are usually set, such that the product emerges just dry from the machine. In such operations, even though the drier temperature can be fairly high, the actual temperature that the wet web experiences is low, due to the high wet load. In conventional commercial practice, the typical temperature range is from 125–150° F.

Typically, traditional photoprocessing equipment can employ a wide variety of different dryers. Almost exclusively, however, the dryers operate by convective heating. That is, a heater is used to heat the air going into the dryer. This lowers the relative humidity of the air, which is then circulated by blowing it through the dryer sections. Several modes of circulation may be employed: co-current or counter-current to the direction of the web, or in a random fashion. Depending on the length of the dryer and the throughput of the web, the temperature of the air entering the dryer can be varied. The faster the drying rate desired, the higher will be the temperature of the air. Although, in the trade the temperatures presently employed typically range from 125° F. to 150° F., the temperature and residence time can be adjusted in accordance with the present invention.

Although convective drying is almost exclusively practiced in conventional equipment, other means of drying may be devised for use in the present invention. These include heating belts, high temperature radiant sources or even by employing a mild vacuum. The most practical of these is to employ a radiant heat source. A radiant heat source can be placed next to the path of the web in the dryer. When the web passes by the heating source, the web temperature is raised, thereby driving the residual water from the web. Although, it is hard to measure a temperature of a radiant heat source, the most relevant temperature is the temperature that the web reaches. This can be measured by sticking a temperature sensitive label on the web. A combination of a convective drying and radiant drying can also be used, particularly to apply the higher temperature to facilitate latex coalescence towards the end of the drying cycle.

In a preferred embodiment, the dryer comprises both a convective heat section and a radiant heat section. Both heating sections heat from top and bottom. The convective heat section comprises a plurality of air vents on top and bottom, whereby hot air is blown through the vents onto the coating. Typically, there are two sets of rollers on each end of this section to move the coating through the dryer, and roller speed can be controlled in the range of about 0–3 inches per second. In a preferred embodiment, the radiant heat section comprises a quartz radiant heating tube on top and one below. A cabinet type dryer that has hot air circulating can also be used.

In one embodiment, the photographic element is dried at the above-mentioned average elevated temperature for a period of time of 1 sec to 2 minutes, preferably 2 to 30 seconds, most preferably between 4 and 10 seconds. Because the drying is designed to provide heat treatment beyond the minimum amount of drying (beyond just dry), the temperature of the surface of the photographic element can achieve a relatively higher temperature than in a conventional photoprocessing drying. The temperature of the photographic element is preferably within 10° F., more preferably within 5° F. of the maximum temperature of the dryer to which the photographic element is exposed. Preferably, the moisture content should be less than 15% of the weight of the dried coating (not including support).

As indicated above, the preferred overcoat formulation used in this invention comprises 30 to 95% by weight (based on the dry laydown of the overcoat) of water-dispersible polymer particles of 0.01 to 0.5 micrometers in average size and 5 to 70% by weight of a water-soluble polymer which is substantially uncrosslinked (based on the dry laydown of the overcoat). The use of less than 5% by weight of crosslinked gelatin or other crosslinked water-soluble polymer in the overcoat (as applied) promotes coalescence during the heating step. It is noted that some gelatin from underlying layers in the photographic element may migrate into the overcoat, during manufacture or photochemical processing, for example, but any such migration is limited and, by definition, is not included in the described composition formulation or in the applied overcoat. In one embodiment, less than 5%, more preferably less than 3%, by weight of solids, of gelatin is included in the overcoat composition. Most preferably, essentially no gelatin is included in the overcoat formulation.

In another preferred embodiment, the present method involves a method of making and processing a photographic element that comprises: (a) a support; (b) at least one silver-halide emulsion layer superposed on a side of said support; and (c) overlying the silver emulsion layer, a processing-solution-permeable protective overcoat having a laydown of at least 0.54 $g/m^2$ (50 $mg/ft^2$) made from a formulation comprising less than 5%, by weight of solids, of crosslinked gelatin and further comprising 30 to 95% by weight of solids, preferably 60 to 90 weight percent, of water-dispersible polymer particles having an average particle size of less than 500 nm and a $T_g$ between −40 to 80° C., preferably 10° C. to 60° C., and 5 to 70%, by weight of solids, preferably 10 to 40 weight percent, of a water-soluble hydrophilic polymer such that more than 30 weight percent of the water-soluble polymer is washed out during photographic processing; wherein the weight ratio of the water-dispersible polymer to the non-crosslinked water-soluble polymer is between 50:50 to 90:10, preferably 60:40 to 85:15, whereby the overcoat forms a water-resistant overcoat after photoprocessing without fusing, namely by maintaining the photographic element at temperature less than 100° C.

The dispersions of water-dispersible polymers used in this invention are latexes or polymers of any composition that can be stabilized in an water-based medium. Such water-dispersible polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins and halogenated olefins, unsaturated acids and esters derived form them, unsaturated nitriles, acrylamides and methacrylamides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. pat. No. 5,594,047 incorporated herein by reference. The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization. The selection of water-dispersible particles to be used in the overcoat is based on the material properties one wishes to have as the protective overcoat in addition to water resistance.

The water-dispersible polymer is selected so that fusing is not required, a potentially significant advantage compared to the prior art, for example U.S. Pat. No. 5,856,051, mentioned above.

In a preferred embodiment of the invention, the water-dispersible polymer is a substantially amorphous, thermoplastic polymer having ionized or ionizable groups or moieties in sufficient number to provide water dispersibility prior to coating. In addition to water-resistance, the polymer dispersions in the finally processed product preferably provides further advantageous properties such as good chemical and stain resistance, wet-abrasion resistance, fingerprint resistance, toughness, elasticity, durability, and/or resistance to various oils.

In the case of carboxylic acid ionic groups, the polymer can be characterized by the acid number, which is preferably greater than or equal to 5 and relatively permeable to water at a pH of greater than 7. Preferably, the acid number is less than or equal to 40, more preferably less than or equal to 30. Preferably, the pH of the developing solution is greater than 8, preferably greater than 9. The water-reducible water-dispersible polymer particles comprising ionized or ionizable groups may be branched, unbranched, crosslinked, uncrosslinked.

In accordance with this invention, the protective overcoat preferably comprises, in addition to the water-dispersible polymer described above, at least one water-soluble hydrophilic polymer. Examples of such water-soluble polymers that may be added include polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly(methacrylic acid), poly (oxymethylene), poly(ethyleneimine), poly(ethylene glycol methacrylate), poly(hydroxy-ethyl methacrylate), poly (vinyl methyl ether), poly(styrene sulfonic acid), poly (ethylene sulfonic acid), poly(vinyl phosphoric acid) and poly(maleic acid) and the like. Such materials are included in "Handbook of Water-Soluble Gums and Resins" by Robert 1. Davidson (McGraw-Hill Book Company, 1980) or "Organic Colloids" by Bruno Jirgensons (Elsvier Publishing Company, 1958). In a preferred embodiment, the polymer is polyvinyl alcohol, which polymer has been found to yield coatings that are relatively uniform and to enhance the diffusion rate of the developer into the underlying emulsions.

The preferred water-soluble polymer is polyvinyl alcohol. The term "polyvinyl alcohol" referred to herein means a polymer having a monomer unit of vinyl alcohol as a main component. Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, "World of PVA", Edited by the Poval Society and Published by Kobunshi Kankoukai, Japan, 1992 and "Poval", Edited by Nagano et al. and Published by Kobunshi Kankoukai, Japan, 1981). The degree of hydrolysis (or saponification) in the polyvinyl alcohol is preferably at least about 70% or more, more preferably at least about 80%. Percent hydrolysis refers to mole percent. For example, a degree of hydrolysis of 90% refers to polymers in which 90 mol % of all copolymerized monomer units of the polymer are vinyl alcohol units. The remainder of all monomer units consists of monomer units such as ethylene, vinyl acetate, vinyl trifluoroacetate and other comonomer units which are known for such copolymers. Most preferably, the polyvinyl alcohol has a weight average molecular weight (MW) of less than 150,000, preferably less than 100,000, and a degree of hydrolysis greater than 70%. If the MW is greater than 100,000, the degree of hydrolysis is preferably less than 95%. Preferably, the degree of hydrolysis is 85 to 90% for a polyvinyl alcohol having a weight average MW of 25,000 to 75,000. These preferred limitations may provide improved manufacturability and processibility. The polyvinyl alcohol is selected to make the coating wettable, readily processable, and in a substantial amount, to readily, not sluggishly, come out of the coating during processing, thereby yielding the final water-resistant product. The optimal amount of polyvinyl alcohol depends on the amount of dry coverage of water- Structure I

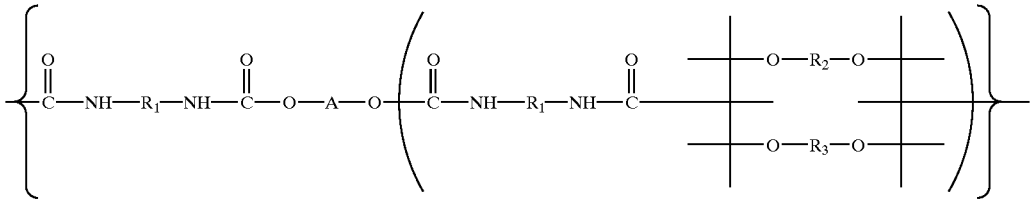

dispersible polymer. In one preferred embodiment of the invention, the polyvinyl alcohol is present in the overcoat in the amount between 1 and 60 weight percent of the water-dispersible polymer, preferably between 5 and 50 weight percent of the water-dispersible polymer, most preferably between 10 and 45 weight percent of the water-dispersible polymer.

Without being bound by theory, it is believed that the water-soluble polymer and water-dispersible polymer form a compatible mixture, which allows the formation of a water-resistant overcoat that does not require fusing, merely elevated temperatures preferably up to about 60° C. It is believed that fusing is not required for several reasons: (a) the substantial absence of cross-linked gelatin and other such crosslinked polymers, and (b) the selection of a water-dispersible polymer that is believed to form a compatible mixture with the hydrophilic water-soluble polymer, c) the selection of the water soluble polymer which is believed to be removed during processing such that the water dispersible polymer coalesces to form a continuous water-resistant overcoat.

Optionally, the coating composition in accordance with the invention may also contain suitable crosslinking agents for crosslinking the water-dispersible polymer. Such an additive can improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered. If a crosslinker is added, care must be taken that excessive amounts are not used as this will decrease the permeability of the processing solution. The crosslinker may be added to the mixture of water-dispersible component and any additional polymers.

The optimal amount of the water-soluble polymer may depend on the amount of dry coverage of water-dispersible polymer. For example, in the case of the combination of a polyurethane polymer and a polyvinyl alcohol polymer, if coverage of a polyurethane polymer is 1.08 g/m$^2$ (100 mg/ft$^2$) or less, then about 20% or less of polyvinyl alcohol, by weight of the polyurethane, provides good results, whereas for higher coverage, for example (1.88 g/m$^2$) 175 mg/ft$^2$, greater than about 25% of the polyvinyl alcohol provides comparably good results.

In one preferred embodiment, the water-dispersible polymer of this invention are polyurethanes, preferably segmented polyurethanes. Polyurethanes are the polymerization reaction product of a mixture comprising polyol monomers and polyisocyanate monomers.

A preferred segmented polyurethane is described schematically by the following structure (I):

wherein $R_1$ is preferably a hydrocarbon group having a valence of two, more preferably containing a substituted or unsubstituted, cyclic or non-cyclic, aliphatic or aromatic group, most preferably represented by one or more of the following structures:

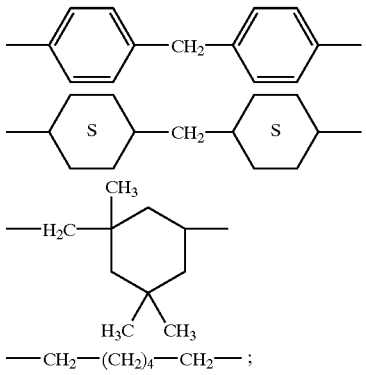

and wherein A represents a polyol, such as a) a dihydroxy polyester obtained by esterification of a dicarboxylic acid such as succinic acid, adipic acid, suberic acid, azelaic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl propane-1,3-diol, or the various isomeric bis-hydroxymethylcyclohexanes; b) a polylactone such as polymers of ϵ-caprolactone and one of the above mentioned diols; c) a polycarbonate obtained, for example, by reacting one of the above-mentioned diols with diaryl carbonates or phosgene; or d) a polyether such as a polymer or copolymer of styrene oxide, propylene oxide, tetrahydrofuran, butylene oxide or epichlorohydrin;

$R_3$ is a phosphonate, carboxylate or sulfonate group; and.

$R_2$ is a diamine or diol having a molecular weight less than about 500. Suitable well known diamine chain extenders useful herein include ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, ethylene methylenebis(2-chloroaniline), 3,3'-dichloro-4,4'-biphenyl diamine. 2,6-diaminopyridine, 4,4'-diamino diphenylmethane, and adducts of diethylene triamine with acrylate or its hydrolyzed products. Also included are materials such as hydrazine, substituted hydrazines such as, for example, dimethyl hydrazine, 1,6-hexamethylene-bis-hydrazine, carbodihydrazide, hydrazides of dicarboxylic acids and sulfonic acids such as adipic acid mono- or dihydrazide, oxalic acid dihydrazide, isophthalic acid dihydrazide, tartaric acid dihydrazide, 1,3-phenylene disulfonic acid dihydrazide, omega-amino-caproic acid dihydrazide, hydrazides made by reacting lactones with hydrazine such as gamma-hydroxylbutyric hydrazide, bis-semi-carbazide, bis-hydrazide carbonic esters of glycols such as any of the glycols mentioned above. Suitable well known diol chain extenders may be any of the glycols or diols listed above for A. $R_3$ is a phosphonate, carboxylate or sulfonate group.

The number of repeating units of Structure I can range from 2 to 200, preferably 20 to 100. The amount of the hard-segment (in the right-hand parenthesis)is preferably 40 to 70 percent by weight. The weight ratio of the $OR_3O$ to the $OR_2O$ repeating unit preferably varies from 0 to 0.1. The water-dispersible polyurethane employed in the invention may be prepared as described in "Polyurethane Handbook", Hanser Publishers, Munich Vienna, 1985.

The term "polyurethane", as used herein, includes branched and unbranched copolymers, as well as IPN and semi-IPNs comprising at least two polymers, at least one of which is a polyurethane.

An IPN is an intimate combination of two or two or more polymers in a network, involving essentially(that may essentially involve) no covalent bonds or grafts between them. Instead, these intimate mixtures of polymers are held together by permanent entanglements produced when at least one of the polymers is synthesized in the presence of the other. Since there is usually molecular interpenetration of the polymers in IPNs, they tend to phase separate less compared to blends. Such interpenetrating polymer network systems and developments are described by L. H. Sperling in "Interpenetrating Polymer Networks and Related Materials," Plenum Press, New York, 1981, in pages 21–56 of "Multicomponent Polymer Materials" ACS Adv. In Chem. No. 211, edited by D. R. Paul and L. H. Sperling, ACS Books, Washington, D.C., 1986, and in pages 423–436 of "Comprehensive Polymer Science", Volume 6, "Polymer Reactions", edited by G. C. Eastmond, A. Ledwith, S. Russo, and P. Sigwalt, Pergamon Press, Elmsford, N.Y., 1989. While an ideal structure may involve optimal interpenetration, it is recognized that in practice phase separation may limit actual molecular interpenetration. Thus, an IPN may be described as having "interpenetrating phases" and/or "interpenetrating networks." If the synthesis or crosslinking of two or more of the constituent components is concurrent, the system may be designated a simultaneous interpenetrating network. If on the other hand, the synthesis and/or crosslinking are carried out separately, the system may be designated a sequential interpenetrating polymer network. A polymer system comprising two or more constituent polymers in intimate contact, wherein at least one is crosslinked and at least one other is linear is designated a semi-interpenetrating polymer network. For example, this type of polymer system has been formed in cured photopolymerizable systems such as disclosed in Chapter 7 of "Imaging Processes and Materials-Neblette's Eighth Edition," edited by J. M. Sturge, V. Walworth & A. Shepp, Van Nostrand Reinhold, New York, 1989.

In one embodiment of the present invention, the water-dispersible polymer is a polyurethane containing pH responsive groups such as acid functionalities and have an acid number greater than or equal to 5, preferably less than or equal to 40, more preferably less than or equal to 30, most preferably from 10 to 25. The weight ratio of the optional vinyl polymer in the polymer can vary from 0 to 80 percent, including a interpenetrating network of a urethane polymer and a vinyl polymer if the amount of vinyl polymer is substantially greater than zero.

In another embodiment of the present invention, the water-dispersible polymer is a polyurethane-containing component that is an IPN or semi-IPN comprising a polyurethane and a vinyl polymer. By the term "vinyl polymer" is meant an addition polymer that is the reaction product of ethylenically unsaturated monomers. Particularly preferred vinyl polymers are acrylics. Vinyls, especially acrylics, have the added advantage of good adhesion, non-yellowing, are adjustable for high gloss, and have a wide range of glass transition and minimum film forming temperatures. Polymerization of vinyl monomers in the presence of the polyurethane copolymer causes the two polymers to reside in the same latex particle as an interpenetrating or semi-interpenetrating network particle resulting in improved resistance to water, organic solvents and environmental conditions, improved tensile strength, and modulus of elasticity. The presence of groups such as carboxylic acid groups provide a conduit for processing solutions to permeate the coating at pH greater than 7. Preferably, the acid number is maintained at less than or equal to 40 to ensure that overcoat has good adhesion to the substrate below, even at high pH, and makes the overcoat more water-resistant.

A preferred IPN comprises an interpenetrating polyurethane and vinyl polymer. Such an IPN is also sometimes referred to in the trade as a urethane-vinyl copolymer or hybrid copolymer, even though involving essentially no chemical bonds between the two polymer chains. Such an IPN may be conventionally produced by polymerizing one or more vinyl monomers in the presence of the polyurethane prepolymer or a chain extended polyurethane. It is possible to have more than two polymers or for each of the polymer chains to be branched or linear. Suitably, in such an IPN, the weight ratio of polyurethane component to vinyl component is 1:20 to 20:1. The preferred weight ratio of the polyurethane to the vinyl component is about 4:1 to about 1:4, more preferably about 1:1 to 1:4.

Preferably, the polyurethane has an acid number of greater than or equal to 5, preferably less than or equal to 40, more preferably less than or equal to 30. Acid number is in general determined by titration and is defined as the number of milligrams of potassium hydroxide (KOH) required to neutralize 1 gram of the polymer.

Preparation of an aqueous dispersion of a polyurethane-containing component, when a single copolymer, is well known in the art. In a preferred method of preparation, the first step is the formation of a medium molecular weight isocyanate terminated prepolymer by the reaction of suitable di or polyol with a stoichiometric excess of di or polyisocyanates. The prepolymer is then generally dispersed in water via water-solubilizing/dispersing groups that are introduced either into the prepolymer prior to chain extension, or are introduced as part of the chain extension agent. Therefore, small particle size stable dispersions can frequently be produced without the use of an externally added surfactant. The prepolymer in the aqueous solution is then subjected to chain extension using diamines or diols to form the "fully reacted" polyurethane.

When a vinyl polymer is present in the polyurethane-containing component, such urethane-vinyl IPN copolymers may be produced, for example, by polymerizing one or more vinyl monomers in the presence of the polyurethane prepolymer or the chain extended polyurethane. The preferred weight ratio of the chain extended polyurethane to the vinyl monomer being about 4:1 to about 1:4, most preferably about 1:1 to 1:4, as mentioned above.

Polyols useful for the preparation of polyurethane dispersions of the present invention include polyester polyols prepared from one or more diols (e.g. ethylene glycol, butylene glycol, neopentyl glycol, hexane diol or mixtures of any of the above) and one or more dicarboxylic acids or anhydrides (succinic acid, adipic acid, suberic acid, azelaic acid, sebacic acid, phthalic acid, isophthalic acid, maleic acid and anhydrides of these acids), polylactone diols prepared from lactones such as caprolactone reacted with a diol, polyesteramides containing polyols prepared by inclusion of amino-alcohols such as ethanol amine during the polyesterification process, polyether polyols prepared from for example, ethylene oxide, propylene oxide or tetrahydrofuran, polycarbonate polyols prepared from reacting diols with diaryl carbonates, and hydroxyl terminated polyolefins prepared from ethylenically unsaturated monomers. Combinations of such polyols are also useful. As mentioned below, polysiloxane polyols are also useful in forming a polyurethane. See, for example, U.S. Pat. No. 5,876,9810 to Anderson, hereby incorporated by reference, for such monomers. A polyester polyol is preferred for the present invention.

Polyisocyanates useful for making the prepolymer may be aliphatic, aromatic or araliphatic. Examples of suitable polyisocyanates include one or more of the following: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cyclopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'-diisocyanatodiphenyl ether, tetramethyl xylene diisocyanate, polymethylene polyphenyl polyisocyanates and the like. Methylene bis(isocyanato cyclohexane) is preferred.

Preferably, a suitable portion of the prepolymer also contains at least one comparatively unreactive pendant carboxylic group, in salt form or preferably neutralized with a suitable basic material to form a salt during or after prepolymer formation or during formation of the dispersion. This helps provide permeability of processing solutions through the overcoat at pHs greater than 7 and dispersibility in water. Suitable compounds that are reactive with the isocyanate groups and have a group capable of forming an anion include, but are not limited to the following: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like. Such a carboxylic-containing reactant is preferably an $\alpha,\alpha$-dimethylolalkanoic acid, especially 2,2-dimethylol propionic acid.

Suitable tertiary amines which may be used to neutralize the acid and form anionic groups for water dispersability are trimethylamine, triethylamine, dimethylaniline, diethylaniline, triphenylamine and the like.

Chain extenders suitable for optionally chain extending the prepolymer are, for example, active-hydrogen containing molecules such as polyols, amino alcohols, ammonia, primary or secondary aliphatic, aromatic, alicyclic araliphatic or heterocyclic amines especially diamines. Diamines suitable for chain extension of the pre- polyurethane include ethylenediamine, diaminopropane, hexamethylene diamine, hydrazine, aminoethyl ethanolamine and the like.

In accordance with one embodiment of this invention, a urethane-vinyl IPN may be prepared by polymerizing vinyl addition monomers in the presence of the polyurethane prepolymer or the chain extended polyurethane. The solution of the water-dispersible polyurethane prepolymer in vinyl monomer may be produced by dissolving the prepolymer in one or more vinyl monomers before dispersing the prepolymer in water.

Suitable vinyl monomers in which the prepolymer may be dissolved contain one or more polymerizable ethylenically unsaturated groups. Preferred monomers are liquid under the temperature conditions of prepolymer formation, although the possibility of using solid monomers in conjunction with organic solvents is not excluded.

The vinyl polymers useful for the present invention include those obtained by copolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

The prepolymer/vinyl monomer solution may be dispersed in water using techniques well known in the art. Preferably, the solution is added to water with agitation or, alternatively, water may be stirred into the solution. Polymerization of the vinyl monomer or monomers is brought about by free radical initiators at elevated temperatures.

Free radicals of any sort may be used including persulfates (such as ammonium persulfate, potassium persulfate, etc., peroxides (such as hydrogen peroxide, benzoyl peroxide, cumene hydroperoxide, tertiary butyl peroxide, etc.), azo compounds (such as azobiscyanovaleric acid, azoisobutyronitrile, etc.), and redox initiators (such as hydrogen peroxide-iron(II) salt, potassium persulfate-sodium hydrogen sulfate, etc.). Preferable free radical initiators are the ones that partition preferably into the oil phase such as the azo-type initiators. Common chain transfer agents or mixtures thereof known in the art, such as alkylmercaptans, can be used to control the polymer molecular weight.

Polymerization may be carried out by various methods. In one method, all of the vinyl monomer (the same or different vinyl monomers or monomer mixtures) is added in order to swell the polyurethane prepolymer. The monomers are then polymerized using an oil soluble free radical initiator after dispersing the mixture in water.

In a second alternative method, some of vinyl monomer may be added to swell the pre-polymer prior to dispersing in water. The rest of the monomer is fed into the system during the polymerization process. Other methods include feeding in all the vinyl monomer during the copolymerization process.

Some examples of polyurethane-containing components used in the practice of this invention that are commercially available include NeoPac® R-9000, R-9699 and R-9030 from NeoResins (Wilmington, Del.), Sancure® AU4010 from BF Goodrich (Akron, Ohio), and Flexthane® 620, 630, 790 and 791 from Air Products. An example of the polyurethane-containing copolymer useful in the practice that is commercially available is the NeoRez® R9679.

In another embodiment of the invention, the water-dispersible polymer is an essentially hydrophobic, substantially amorphous, thermoplastic polyester polymer in which ionic groups or moieties are present in sufficient number to provide water dispersibility prior to coating. The polyester dispersions provide advantageous properties such as good film-formation, good chemical-resistance, wet-abrasion resistance, excellent fingerprint resistance, toughness, elasticity and durability. Furthermore, the polyesters exhibit tensile and flexural strength and resistance to various oils.

Procedures for the preparation of polyester ionomers are described in U.S. Pat. Nos. 3,018,272; 3,563,942; 3,734,874; 3,779,993; 3,929,489; 4,307,174, 4,395,475, 5,939,355 and 3,929,489, the disclosures of which are incorporated herein by reference. The substantially amorphous polyesters useful in this invention comprise dicarboxylic acid recurring units typically derived from dicarboxylic acids or their functional equivalents and diol recurring units typically derived from diols. Generally, such polyesters are prepared by reacting one or more diols with one or more dicarboxylic acids or their functional equivalents (e.g. anhydrides, diesters or diacid halides), as described in detail in the cited patents. Such diols, dicarboxylic acids and their functional equivalents are sometimes referred to in the art as polymer precursors. It should be noted that, as known in the art, carbonylimino groups can be used as linking groups rather than carbonyloxy groups. This modification is readily achieved by reacting one or more diamines or amino alcohols with one or more dicarboxylic acids or their functional equivalents. Mixtures of diols and diamines can be used if desired.

Conditions for preparing the polyesters useful in this invention are known in the art as described above. The polymer precursors are typically condensed in a ratio of at least 1 mole of diol for each mole of dicarboxylic acid in the presence of a suitable catalyst at a temperature of from about 125° to about 300° C. Condensation pressure is typically from about 0.1 mm Hg to about one or more atmospheres. Low-molecular weight by-products can be removed during condensation, e.g. by distillation or another suitable technique. The resulting condensation polymer is polycondensed under appropriate conditions to form a polyester. Polycondensation is usually carried out at a temperature of from about 150 to about 300° C. and a pressure very near vacuum, although higher pressures can be used.

Polyester ionomers, useful in the present composition, contain at least one ionic moiety, which can also be referred to as an ionic group, functionality, or radical. In a preferred embodiment of the invention, the recurring units containing ionic groups are present in the polyester ionomer in an amount of from about 1 to about 12 mole percent, based on the total moles of recurring units. Such ionic moieties can be provided by either ionic diol recurring units and/or ionic dicarboxylic acid recurring units, but preferably by the latter. Such ionic moieties can be anionic or cationic in nature, but preferably, they are anionic. Exemplary anionic ionic groups include carboxylic acid, sulfonic acid, and disulfonylimino and their salts and others known to a worker of ordinary skill in the art. Sulfonic acid ionic groups, or salts thereof, are preferred.

One type of ionic acid component has the structure

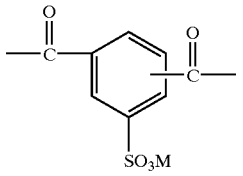

where M=H, Na, K or $NH_4$.

Ionic dicarboxylic acid recurring units can be derived from 5-sodiosulfobenzene-1,3-dicarboxylic acid, 5-sodiosulfocyclohexane- 1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Specification No. 1,470,059 (published Apr. 14, 1977). Other suitable polyester ionomers for protective overcoats in the imaged elements of the present invention are disclosed in U.S. Pat. Nos. 4,903,039 and 4,903,040, which are incorporated herein by reference.

Another type of ionic dicarboxylic acid found useful in the practice of this invention are those having units represented by the formula:

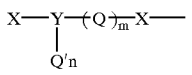

wherein each of m and n is 0 or 1 and the sum of m and n is 1; each X is carbonyl; Q has the formula:

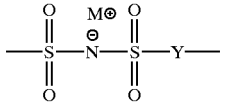

Q' has the formula:

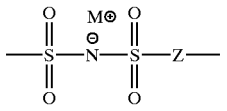

Y is a divalent aromatic radical, such as arylene (e.g. phenylene, naphthalene, xylylene, etc.) or arylidyne (e.g. phenenyl, naphthylidyne, etc.); Z is a monovalent aromatic radical, such as aryl, aralkyl or alkaryl (e.g. phenyl, p-methylphenyl, naphthyl, etc.), or alkyl having from 1 to 12 carbon atoms, such as methyl, ethyl, isopropyl, n-pentyl, neopentyl, 2-chlorohexyl, etc., and preferably from 1 to 6 carbon atoms; and M is a solubilizing cation and preferably a monovalent cation such as an alkali metal or ammonium cation.

The protective overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the water-dispersible polymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284, 294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No.308119, published December 1989, page 1006.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874, 205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The imaging element can be coated applied by several different methods. For example, the polymer overcoats can be coated simultaneously with the gelatin or emulsion containing layers using a slide hopper, and the entire coating was chill-set, dried and wound. However, any of a number of well known techniques can be employed for applying the coatings simultaneously to a substrate comprising the support, such as the use of multi-stations, wherein each station may be able to coat one or more solution. Preferably, a commercial embodiment involves simultaneous co-extrusion or slide hopper coating. Also, on a commercial scale, the coatings are applied to a continuous web, which is later cut into sheets for packaging and sale for individual use by the consumer.

After applying the coated layers to the support, it may be dried over a suitable period of time. The layers are generally dried by simple evaporation, which may be accelerated by known techniques such as convection heating. Known coating and drying methods are described in further detail in *Research Disclosure* No. 308119, Published December 1989, pages 1007 to 1008.

The laydown of the overcoat will depend on its field of application. For a photographic element, the laydown of the polyurethane-containing copolymer is suitably at least 0.54 $g/m^2$ (50 $mg/ft^2$), preferably 1.08 to 5.38 $g/m^2$ (100 to 500 $mg/ft^2$), most preferably 1.61 to 3.23 $g/m^2$ (150 to 300 $mg/ft^2$). It may be advantageous to increase the amount of polyvinyl alcohol in the overcoat as the laydown increases in order to improve the developability. In the event of cracking, especially at lower levels of polyvinyl alcohol or when using an alternative film-forming polymer, it may be advantageous to adjust the temperature and/or humidity of the drying step to eliminate or reduce this cracking problem.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of a photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure,* Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. Pat. Nos. 4,279,945 and 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

During photoprocessing, the photographic element is preferably developed in an alkaline developer solution having a pH greater than 7, preferably greater than 8, more preferably greater than 9. This allows the developer to penetrate the protective coating. After the pH is reduced, for example in a bleach fix solution, the protective overcoat becomes relatively water resistant. The addition of polyvinyl alcohol and/or other water-soluble polymers, according to one embodiment of the present invention, facilitates the present method. For example, it has been found polyvinyl alcohol polymer can provide improved wettability of the surface during processing and, at the same time, allows more of the polyvinyl alcohol to be washed out during the processing, so that the final product is more water resistant. Suitably at least 30%, preferably greater than 50%, more preferably greater than 75% of the original amount of a water-soluble polymer in the overcoat is washed out during processing of the exposed photographic element, such that the final product is depleted in water-soluble polymer and hence relatively more water resistant. Although the processing-solution-permeable overcoat does not require fusing, optional fusing may improve the water resistance further The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The present invention is illustrated by the following examples. Unless otherwise indicated, the molecular weights herein are weight average molecular weights, as determined by size exclusion chromotagraphy described below.

EXAMPLES

Characterization of Polymeric Materials

Glass Transition Temperature and Melting Temperature

Both glass transition temperature (Tg) and melting temperature (Tm) of the dry polymer material were determined by differential scanning calorimetry (DSC), using a ramping rate of 20° C./minute. Tg is defined herein as the inflection point of the glass transition and Tm is defined herein as the peak of the melting transition. The minimum film forming temperature of the polymers are those reported by the manufacturer. The film forming temperature is the lowest temperature at which the aqueous polymer dispersion can be dried and still form a film.

Polymer Preparation

P1 (Polyurethane Dispersion)PU

The same preparation scheme was used as for P3 except diethylene glycol was substituted for a portion of the 1,4-butanediol as chain extender, such that the monomer feed ratio on a weight basis was 33.0% polycarbonate polyol, 4.4% dimethylol propionic acid, 9.5% butanediol, 4.3% diethylene glycol and 48.9% isophorone diisocyanate. Tetrahydrofuran was removed by heating under vacuum to give an aqueous dispersion at 19.5% solids. Glass transition temperature was 55° C. as measured by DSC, and weight average molecular weight was 19,100.

P2 (Polyurethane-Acrylic Copolymer Dispersion)MT

Into a dry reactor was charged 96 grams of a diol (Millester® 9–55, MW2000 from Polyurethane Corporation of America), 87 grams of the methylene bis(4-cyclohexyl) isocyanate (Desmodur®W) and 0.02 grams of dibutyltin dilaurate (Aldrich). The mixture was held with stirring for 90 minutes at 94° C. under a blanket of argon after which 14 grams of dimethylol propionic acid was added to the reactor and the mixture stirred for 1.5 hours at 94° C. At this point 24 grams of methyl methacrylate were added and stirred for 1 hour at the same temperature. The resultant prepolymer was cooled to below 40° C., dissolved in a vinyl monomer mixture consisting of 113 grams of n-butyl acrylate, 183 grams of methyl methacrylate, and 5 grams of acetoacetoxyethyl methacrylate, and then treated with 11 grams of triethylamine and 2.5 grams of initator (AIBN). To this mixture was added 1000 ml deoxygenated water followed by 10 grams of ethylene diamine in 20 grams of water. The dispersion was heated to 65° C., held there with stirring for 2 hours and heated further to 80° C. for 10 hours. The resulting dispersion of the urethane acrylic copolymer had an acid number of 11. The acrylic segment of the polymer had a weight ratio of 37.5:60.8:1.7 of n-butyl acrylate:methyl methacrylate: acetoacetoxyethyl methacrylate. The urethane to acrylate weight ratio was 40:60.

P3 (OMT)—The preparation and composition of this polymer was similar to P2, except that the acrylic segment was 37.5:62.5 n-butyl acrylate:methyl methacrylate.

P4 (Polyester Ionomer Dispersion)

AQ-55, a polyester ionomer dispersion, was used as-received from Eastman Chemical Co. The Tg of this material was 55° C.

NEOCRYL A633 (P5), A6092 (P6), are acrylic latexes. NEOPAC R9030 (P7) is an acrylic-urethane latex. These latexes were obtained from Avecia (Zeneca Resins, Wilmington, Del.). There were used as is, with appropriate melt preparation.

Additional Materials (1) AIRVOL 203 poly(vinyl alcohol) (PVA) was obtained from Air Products which was 87 to 89% hydrolyzed (by hydrolyzed is meant that the acetate groups in the monomeric units are converted to hydroxy groups) and had a number-average molecular weight of 12,000 and a weight-average molecular weight of 35,000.

(2) CX-100, a polyfunctional aziridine crosslinker for the polyurethane-acrylic copolymer dispersion, was obtained from Neo Resins (a division of Avecia).

(3) ACUSOL ASE60 was alkali swellable polymer used as a thickener (commercially available from Rohm and Haas)

Photographic Sample Preparation

Samples was prepared by coating in sequence blue-light sensitive layer, interlayer, green-light sensitive layer, UV layer, red-light sensitive layer, UV layer and the overcoat comprising the polymers of the current invention, on photographic paper support. The components in each individual layer are described below.

Blue Sensitive Emulsion (Blue EM-1). A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6$\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1): A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3$\mu$m in edge length size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1): A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 $\mu$m in edgelength size. The emulsion is optimally sensitized by the addition of glutaryldiaminophenyldisulfide, sodium thiosulfate, tripotassium bis {2-[3 -(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C, pH adjusted to 6.0 and red sensitizing dye RSD-1 is added.

Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | Diundecyl phthalate | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | Diundecyl phthalate | 10.40 |
| | ST-1 | 3.698 |
| | ST-3 | 26.39 |
| | Dye-2 | 0.678 |
| | 5-chloro-2-methyl-4-isothiazolin-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | Diundecyl phthalate | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |

-continued

| | | |
|---|---|---|
| | IC-35 | 21.59 |
| | IC-36 | 2.397 |
| | UV-1 | 32.99 |
| | Dibutyl sebacate | 40.49 |
| | Tris(2-ethylhexyl)phosphate | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | Tris(2-ethylhexyl)phosphate | 7.404 |
| | 5-chloro-2-methyl-4-isothiazolin-3-one/2-methyl-4-isothiazolin-3-one(3/1) | 0.009 |
| Layer 7 | SOC (polymer variations as described) | |

BSD-4

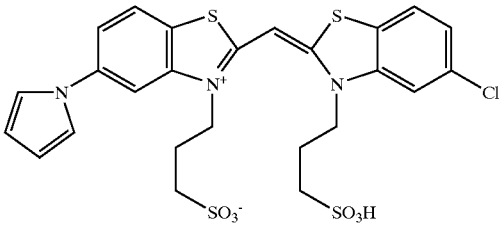

GSD-1

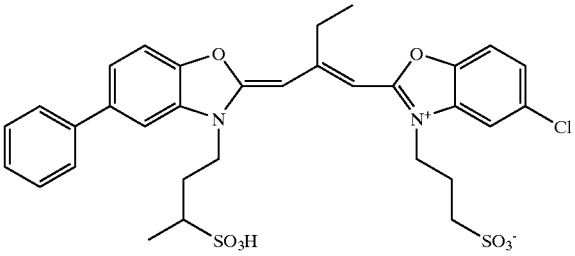

RSD-1

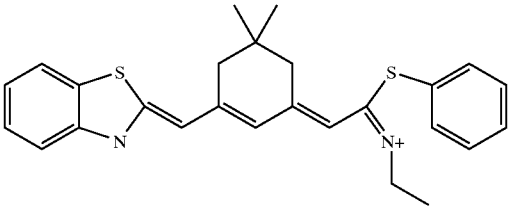

$(CH_2)_3SO_3^-$

Y-4

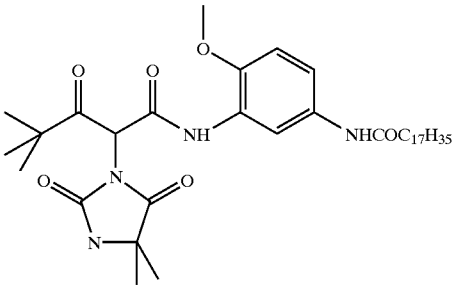

-continued

M-4

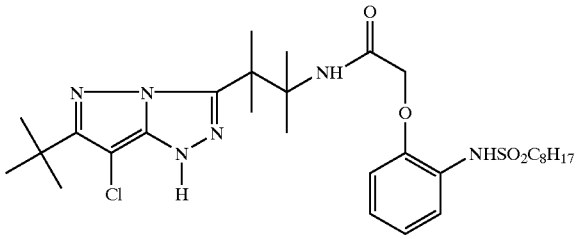

IC-35

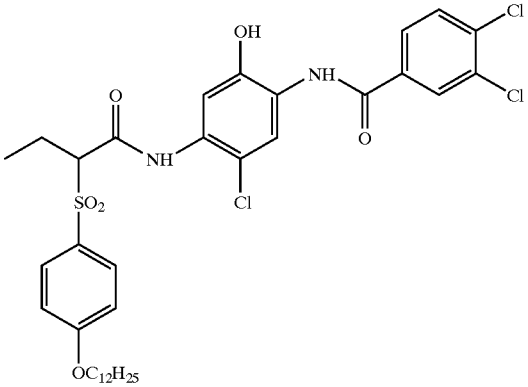

IC-36

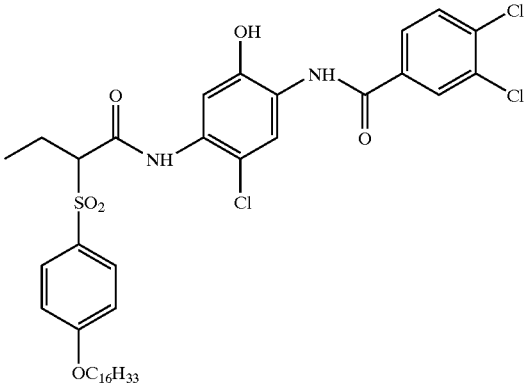

Dye-1

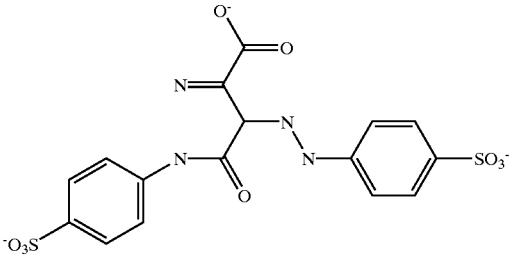

Dye-2

-continued

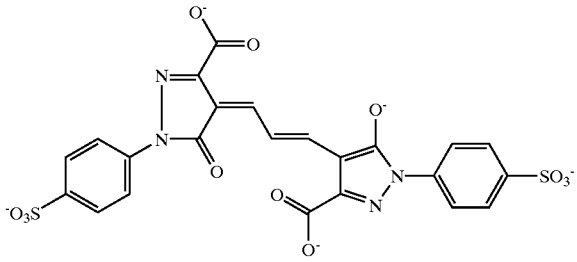

Dye-3

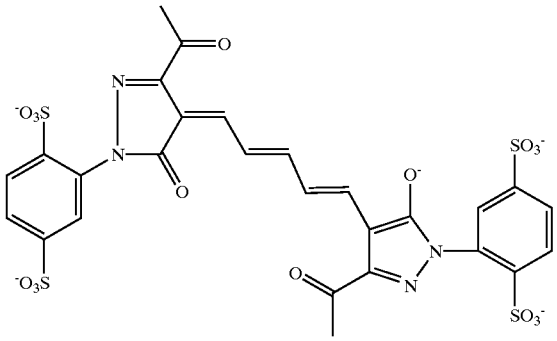

ST-1

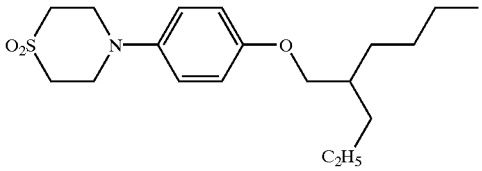

ST-3

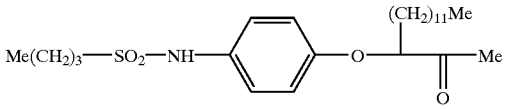

ST-4

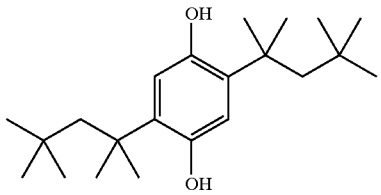

ST-16

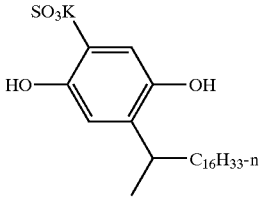

ST-23

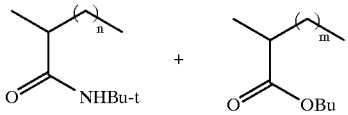

n:m = 1:1; MW = 75,000–100,000

-continued

ST-24

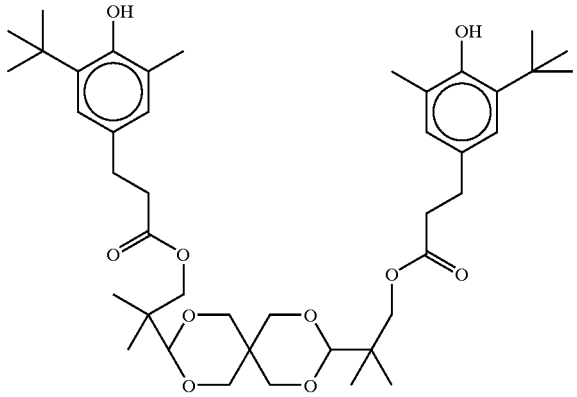

UV-1

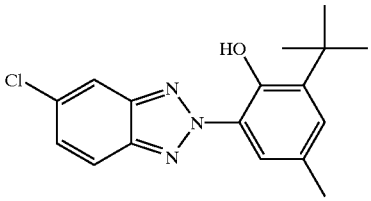

UV-2

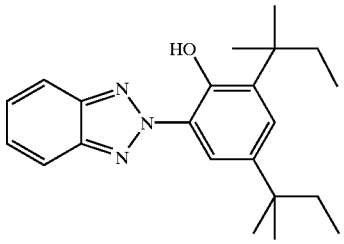

SF-1

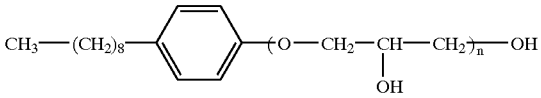

SF-2

$CF_3.(CF_2)_7.SO_3Na$

Coating Method Descriptions

The overcoats were coated by two methods. In the first method (sequential), the underlying gelatin containing layers were coated on a slide hopper, chill set, dried and wound. In this case the gelatin containing layers consisted of 100 mg/ft2 of gelatin. The wound roll was immediately coated with the overcoat as a single layer. This type of a coating method simulates a two station coating operation. In the second method (simultaneous) which was used, the polymer overcoats were coated simultaneously with the gelatin containing layers using a slide hopper. The entire coating was chill-set, dried and wound, prior to incubation and testing. All gelatin coatings contained BVSM crosslinker at a level of 2% with respect to the amount of gelatin. The gelatin containing layers consisted of the imaging layers described earlier starting from the layer closest to the support: 1) Blue sensitive layer, 2) interlayer 3) Green sensitive layer, 4) M/C Interlayer, 5) Red sensitive layer, 6) UV containing layer. The support used in all the coatings was resin coated paper.

Prior to coating the support was treated with a Corona Discharge Treatment.

Processing Description

Since all coatings were done in white light processing was done using a developer solution devoid of CD3 and BD89. This is done in order to result in Dmin processed coatings, in order to facilitate the observation of staining. The processing steps were as follows (all solutions at 40° C.).

1. 45 seconds in developer (RA12 or T213 w/o CD3 or BD89)
2. 45 seconds in RA4 Bleach/Fix
3. 90–120 seconds water wash Dryer Description The "Stand Alone Coater/Dryer" consists of a convective heat section and a radiant heat section. Both heating sections heat from top and bottom. The Convective Heat Section was approximately 4.5 in long with 3 air vents on top and bottom. Hot air is blown through the vents onto the coating. The maximum temperature is ~190° F. There are two sets of rollers on each end of this section to move the coating through the dryer. Roller speed can be controlled in the range of ~0–3 inches per second. The Radiant Heat Section was ~2 in long with one quartz radiant heating tube on top and one below. The intensity can be varied but temperature could only be measured as greater than 400° F. A cabinet type dryer which has air circulating at 160° F. was also used.

Unless otherwise mentioned, the drying was carried out after step 3 of the processing listed above:

Coatings are processed and run through the dryer directly after the water wash (coatings are wet). The rollers pull the coating into the dryer through the convective section first and the radiant section second. The normal setup was 1 in/sec, 4–7 seconds at a higher temperature, 185° F. convective with radiant heat at >400° F.

Stain Measurement Procedure

Stain propensity was tested by placing a drop of the staining agent, which was fruit punch (containing dye) on a processed dry coating. The agent was left for ten minutes before rinsing with water. Stain densities were measured using an XRITE-10 densitometer in reflection mode. Fruit punch stains were measured with magenta Status A filter.

Example 1

The polymer P2 was applied in a sequential manner with a gelatin underlying layer. In other coating samples, 175 mg/ft2 of P2 or P3 polymer was coated as an overcoat simultaneously with gelatin containing imaging layers. The overcoat also contained 61.25 mg/ft2 of AIRVOL PVA 203. CX-100 was used as a crosslinker. The normal drying method used involved drying in a cabinet at 160° F. after step 3 of processing. The high temperature drying involved passing through the stand alone dryer with the convective section set at 185° F. and the radiant section on (>400° F.). The web speed through the dryer was 1 inch/sec.

TABLE 1

| Coating | Coating method | Polymer type | Fruit Punch Stain Density w Normal drying 160° F. | Fruit Punch Stain Density w High Temperature Drying – 185 + F. |
|---|---|---|---|---|
| 0C1 | Sequential | P2 | 0.42 | 0.28 |
| 0C2 | Simultaneous | P2 | 0.44 | 0.12 |
| 0C3 | Simultaneous | P3 | 0.49 | 0.12 |

The data in Table 1 shows that the elevated drying temperature is needed to coalesce the polymer in the overcoat layer and make it substantially impermeable to staining agents.

Example 2

The imaging element used in this example was OC3, which consisted of the imaging layers described in photographic sample preparation with the polymer overcoat containing 175 mg/ft2 of P3 and 61.25 mg/ft2 of AIRVOL PVA203. The overcoat was coated simultaneously with the imaging layers. Two PVA203. The overcoat was coated simultaneously with the imaging layers. Two types of drying conditions were applied to these coatings. The high temperature (HT) consisted of convective heat of 185° F. followed by radiant heating. A low temperature drying (LT) consisted of drying at 150° F. in an oven. The coatings were processed according to the steps described earlier. At the processing step one or two drying steps were applied, in order to identify, the critical factors of drying that are needed to make the coatings stain resistant. Each coating was subsequently tested for stain resistance:

TABLE 2

| Drying Step 1 | Drying Step 2 | Stain Density |
|---|---|---|
| None | LT applied after processing step 3 | 0.44 |
| HT prior to processing step 1 | LT applied after processing step 3 | 0.48 |
| Coating wet with a film of water and then HT drying prior to processing step 1 | LT applied after processing step 3 | 0.47 |
| LT after processing step 3 | HT after LT drying | 0.43 |
| None | HT applied after processing step 3 | 0.12 |

The data in Table 2 show that the application of the high temperature drying has to be applied at a critical step in the processing. It cannot be applied prior to processing, whether the film is heated dry or in the presence of a water film. That is, when the PVA is still in the coating (the water film does not allow the PVA to exit the overcoat), the stain resistance property cannot be achieved by high temperature heating. Similarly, if the imaging element is dried at low temperature after step 3 of processing and the high temperature treatment is applied to a dried film, the stain resistance cannot be achieved. The novelty of this invention is that the high temperature treatment has to be applied to the imaging element, while it is wet, after it has gone through the three processing steps.

Example 3

A variety of polymeric materials were used as overcoats. The classes of polymers included urethane-acrylic copolymers, acrylic polymers, and a polyester ionomer. All overcoats were coated simultaneously with the imaging layers as described in Example 1. All overcoats contained the polymer at a laydown of 175 mg/ft2 and AIRVOL PVA203 at a laydown of 61.25 mg/ft2. The coated samples were processed and dried either by normal (cabinet at 150° F.) or at high temperature (standalone drier with 185° F. convective and >400° F. radiant). Stain testing with punch was carried out as described above.

TABLE 3

| Coating ID | Polymer ID | Polymer type | Minimum film forming temp | Fruit Punch Density Normal Dry | Fruit Punch Density High Temp Dry |
|---|---|---|---|---|---|
| 0C3 | P3 | Urethane-Acrylic | | 0.49 | 0.12 |
| 0C4 | P1 | Polyester ionomer | 55 | 0.39 | 0.15 |
| 0C5 | P5 | Acrylic | 49 | 0.66 | 0.19 |
| 0C6 | P6 | Acrylic | 50 | 0.59 | 0.08 |
| 0C7 | P7 | Acrylic | | 0.68 | 0.11 |

The results above show that all classes of polymers respond favorably to high temperature drying after step 3 in the processing. It is preferred that the minimum film forming temperature of the polymers be below 100° C. in order to respond favorably to high temperature drying.

The invention has been described in detail with particular reference to certain preferred embodiments thereof, but it will be understood that variations and modifications can be effected within the spirit and scope of the invention.

What is claimed is:

1. A method of making a photographic print comprising in order the following steps:

(a) providing a photographic element comprising a support, a silver-halide emulsion layer superposed on a side of said support, a processing-solution-permeable overcoat overlying the silver-halide emulsion layer, said overcoat having a dry laydown of at least 0.54 $g/m^2$ (50 $mg/ft^2$),which overcoat is made from a coating composition comprising 30 to 95%, by weight of solids, of water-dispersible polymer in the form of particles having an average particle size of less than 500 nm and 5 to 70%, by weight of solids, of water-soluble polymer such that more than 30 weight percent of the water-soluble polymer is washed out during photographic processing, wherein the protective overcoat is applied to a substrate comprising the support of the photographic element simultaneously with the silver-halide emulsion layer, and;

(b) developing the photographic element in a developer solution having a pH greater than 7 to obtain the photographic print;

(c) bleaching, fixing, and washing the photographic element; and (d) drying the wet photographic element to an elevated temperature over 160° F. to provide the overcoat with enhanced stain-resistance and water-resistance in the final product.

2. The method of claim 1 wherein the weight ratio of water-dispersible polymer to water-soluble polymer is between 50:50 to 90:10 and the overcoat comprises less than 5% by weight of crosslinked gelatin in the applied overcoat.

3. The method of claim 1 wherein the $T_g$ of the water-dispersible polymer is between −40° C. and 80° C.

4. The method of claim 1 wherein the minimum film-forming temperature of the polymers in the overcoat is below 100° C.

5. The method of claim 1 wherein the photographic element is dried at a temperature of 170 to 200° F.

6. The method of claim 5 wherein the photographic element is dried at said temperature for a period of time of 1 sec to 2 min.

7. The method of claim 1 wherein the photographic element is not fused.

8. The method of claim 1 wherein the overcoat is applied to a substrate in the form of a moving web in a commercial manufacturing facility.

9. The method of claim 1 wherein the photographic element is dried by means of a convection heater.

10. The method of claim 1 wherein the photographic element is dried in a radiant heater.

11. The method of claim 1 wherein the photographic element is dried in a convection heater followed by a radiant heater.

12. The method of claim 1 wherein the surface temperature the photographic element, following the drying of step(d), achieves a temperature within 10° F. of said elevated temperature.

13. The method of claim 1 wherein the surface temperature the photographic element, following the drying of step(d), achieves a temperature within 5° F. of said elevated temperature.

14. The method of claim 1 wherein said water-dispersible polymer is selected from the group consisting of polyesters, polyamides, polyurethanes, polyureas, polyethers, polycarbonates, polyacid anhydrides, urethane acrylic hybrid polymers derived from vinyl ethers, vinyl heterocyclic compounds, styrenes, olefins, halogenated olefins, unsaturated acids and esters thereof, unsaturated nitriles, acrylamides and methacrylamides, and vinyl ketones, poly (epoxides) and copolymers thereof, and combinations thereof.

15. The method of claim 14 wherein said water-dispersible polymer comprises ionized or ionizable groups.

16. The method of claim 1 wherein said water-soluble polymer is selected from the group consisting of polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly (methacrylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid), and copolymers thereof, and combinations thereof.

17. The method of claim 1 wherein the weight average molecular weight of said water -soluble polymer is less than 300,000.

18. The method of claim 17 wherein the weight average molecular weight of said water-soluble polymer is 1500 to 100,000.

19. The method of claim 14 wherein said water-dispersible polymer has an acid number of greater than or equal to 5.

20. The method of claim 1 wherein the support comprises a biaxially oriented polymeric laminate.

* * * * *